US006718639B1

(12) United States Patent
Kazanjian

(10) Patent No.: US 6,718,639 B1
(45) Date of Patent: Apr. 13, 2004

(54) SELF-SHARPENING UTILITY KNIFE

(76) Inventor: Byron John Kazanjian, 43401 Anza Rd., Temecula, CA (US) 92592

( * ) Notice: Subject to any disclaimer, the term of this patent is extended or adjusted under 35 U.S.C. 154(b) by 0 days.

(21) Appl. No.: 10/370,203

(22) Filed: Feb. 19, 2003

(51) Int. Cl.[7] ..... B26B 1/08; B26B 11/00
(52) U.S. Cl. ..... 30/138; 30/162
(58) Field of Search ..... 30/162, 138, 335; 7/120

(56) References Cited

U.S. PATENT DOCUMENTS

| | | | | |
|---|---|---|---|---|
| 1,465,751 A | | 8/1923 | Wright | |
| 1,507,043 A | | 9/1924 | Blow | |
| 1,890,506 A | | 12/1932 | Frank et al. | |
| 2,291,128 A | | 7/1942 | Yarrow | |
| 2,337,158 A | | 12/1943 | Frank | |
| 2,416,929 A | * | 3/1947 | Kjorsvik | 30/138 |
| 2,874,462 A | * | 2/1959 | Benedict, Jr. et al. | 30/162 |
| 4,862,590 A | | 9/1989 | Winyard et al. | |
| 5,099,578 A | * | 3/1992 | Jan | 30/162 |
| 5,519,908 A | | 5/1996 | Steinman et al. | |
| 6,249,975 B1 | * | 6/2001 | Lin | 30/162 |
| 6,487,778 B1 | | 12/2002 | Gringer et al. | |

FOREIGN PATENT DOCUMENTS

EP 0271223 A1 6/1888

* cited by examiner

*Primary Examiner*—Hwei-Siu Payer
(74) *Attorney, Agent, or Firm*—Gene Scott-Patent Law & Venture Group

(57) ABSTRACT

A cutter has a blade housing; a blade carrier; and a blade engaged within the blade carrier. The blade housing receives the blade carrier and blade in sliding engagement along a longitudinal direction for retracting and extending the blade forward of the blade housing. The blade carrier is further movable between an upwardly biased position and a downwardly depressed position within the blade housing against a spring biasing element which urges the blade carrier to the upwardly biased position for locking the blade carrier in one of a plurality of slots for fixing the blade at a selected degree of extension. The blade carrier may be partially depressed to disengage the blade carrier from the slots enabling longitudinal motion and may be fully depressed to engage a cutting edge of the blade with a sharpening stone for honing the blade as the blade carrier moves within the housing.

15 Claims, 3 Drawing Sheets

SELF-SHARPENING UTILITY KNIFE

BACKGROUND OF THE INVENTION

INCORPORATION BY REFERENCE: Applicant(s) hereby incorporate herein by reference, any and all U.S. patents, U.S. patent applications, and other documents and printed matter cited or referred to in this application.

1. Field of the Invention

This invention relates generally to packing knives and box cutters and more particularly to a hand-held knife with retractable blade and shelf sharpening feature.

2. Description of Related Art

The following art defines the present state of this field:

Wright, U.S. Pat. No. 1,465,751 describes a knife comprising a hollow sheath, a blade holder slidably mounted in the sheath and provided with a slot at the front end, a blade having, one end thereof mounted in the slot, and a clamp over the front end and adapted to clamp the blade into operative position and to release the same for removal thereof.

Blow, U.S. Pat. No. 1,507,043 describes a pocket knife, a casing, at least one blade slidably mounted therein, sharpening means arranged at the end of the casing to operate on the cutting edge of the blade spring means to hold the cutting edge of the blade in engagement with the sharpening means and a locking device for securing the blade in the open or closed position.

Frank et al., U.S. Pat. No. 1,890,506 describes an elongated, hollow handle having an elongated slot formed through one side near one end, a leaf spring mounted over the slot and having one end fastened to the handle at the inner end of the slot, the forward end of the sping being free, a sharpening element mounted at the inner side of the free end of the spring, a knife blade and connected blade rod reciprocatingly mounted through the handle, the blade being at the same end with the sharpening element and the edge of the blade being turned towards the element, the blade being beveled at its juncture with the said blade rod so as to enable the sharpening element to clamp and ride upon the edge of the blade as it is drawn backward.

Frank, U.S. Pat. No. 2,337,158 describes an elongated, frame-like handle, formed open through its medial portion and having aligned slots formed longitudinally through its ends, a thin cutting blade and a connected thin blade rod pass slidably through the handle and through the end slots therethrough, and a means on the handle for sharpening the knife as it is reciprocated.

Yarrow, U.S. Pat. No. 2,291,128 describes a knife assembly comprising a blade having a lengthwise guide way, a shaft for the blade removably attachable to a handle, which provides pivotal engaging means at its inner end, said engaging means cooperating with said guide way to, at times, direct the blade's edge against a sharpening means, which is supported by the handle, and a means for detachably fastening the free end of the handle to the haft.

Winyard et al., U.S. Pat. No. 4,862,590 describes a retractable blade knife having a self-sharpening facility, which can be selectively rendered inoperable. The sharpener is spring biased in an upward direction so as to be urged into engagement with the cutting edge of a knife blade. A manually operable release means is provided to permit the sharpener to be held in an inoperable position. An assembly of which the sharpener forms a part also functions as a stop means which positively prevents movement of the knife blade into its extended position. Such extension is possible only upon operation of the release means, but that is only necessary during initial outward movement of the knife blade. The sharpener is arranged to sharpen the cutting edge of the blade up to the tip of the blade. Positive locking means is provided to prevent inward movement of the blade when working under load in the extended position.

Steinman et al, U.S. Pat. No. 5,519,908 describes a combination tool having a knife blade, a rasping blade and a knife blade sharpener combined into a single handle member. Preferably, the knife blade is extendable and retractable from and into the handle member, respectively. In the preferred embodiment, the knife blade sharpener is biased upward against the knife blade but fixed longitudinally. Accordingly, the knife blade sharpener abrasively contacts the knife blade thereby removing debris from the knife blades and maintaining the knife blade in a sharpened configuration. The rasping blade is preferably positioned in a rasping blade housing secured to the handle member opposite the knife blade and the knife blade sharpener; In operation, the user is not required to alter his or her grip when changing from cutting to rasping but merely moves the handle member forward to bring the rasping blade into contact with the material to be rasped.

Gringer et al., U.S. Pat. No. 6,487,778 describes an improved automatically retractable cutting device including a housing having a guide slot, with one or more notches disposed in the guide slot, a return spring within the housing, and a blade carrier disposed within the housing and biased by the return spring. The blade carrier includes a thumb piece extending through the guide slot, the thumb piece having a protuberance adapted to at least partially frictionally engage the notch during movement of the thumb piece along the guide slot to enable the thumb piece to be held in position adjacent to the notch with reduced force. Each notch may include a forward direction ramping surface, whereby reduced force is required to prevent further blade extension, and/or a reverse direction ramping surface, whereby reduced force is required to prevent blade retraction. Each ramping surface is preferably angled at less than ninety degrees. The housing may be formed by attachable halves, each of which includes notches, whereby the notches are substantially symmetrically aligned when the housing is assembled.

McPherson's Limited, EP 0271223 describes a retractable blade knife having a self-sharpening facility, which can be selectively rendered inoperable. The sharpener is spring biased in an upward direction so as to be urged into engagement with the cutting edge of a knife blade, and manually operable release means is provided to permit the sharpener to be held in an inoperable position. An assembly of which the sharpener forms part also functions as stop means which positively prevents movement of the knife blade into its extended position. Such extension is possible only upon operation of the release means, but that is only necessary during initial outward movement of the knife blade. The sharpener is arranged to sharpen the cutting edge of the blade up to the tip of the blade. Positive locking means is provided to prevent inward movement of the blade when working under load in the extended position.

The prior art teaches a utility knife with pressure reducing slot, several versions of knifes with retractable blades, a knife with built-in sharpener, a cutting and rasping combination tool, a retractable pocket knife, and a knife with a pivotal sharpening assembly, but does not teach a retracting blade knife enabled for blade extension-retraction with and without sharpening action depending upon downward finger pressure on an actuation lever. The present invention fulfills this need and provides further related advantages as described in the following summary.

SUMMARY OF THE INVENTION

The present invention teaches certain benefits in construction and use which give rise to the objectives described below.

A cutter has a blade housing; a blade carrier; and a blade engaged within the blade carrier. The blade housing receives the blade carrier and blade in sliding engagement along a longitudinal direction for retracting the blade into the housing and for extending the blade forward of the blade housing. The blade carrier is further movable between an upwardly biased position and a downwardly depressed position within the blade housing against a spring biasing element which urges the blade carrier to the upwardly biased position for locking the blade carrier in one of a plurality of slots for fixing the blade at a selected degree of extension. The blade carrier may be partially depressed to disengage the blade carrier from the slots enabling longitudinal motion for blade extension-retraction, and may be fully depressed to engage a cutting edge of the blade with a sharpening stone for honing the blade as the blade carrier moves. The prior art does not teach a tool with this dual depression action so that sharpening the blade only takes place when necessary and when desired, yet the same finger action is used to drive the blade during normal use. The prior art also does not teach the use of three sharpening surfaces so that the blade may be sharpened over the full length of the blade including the blade tip.

A primary objective of the present invention is to provide an apparatus and method of use of such apparatus that provides advantages not taught by the prior art.

Another objective is to provide such an invention capable of extending and retracting a knife blade with simple finger manipulation.

A further objective is to provide such an invention capable of engaging and disengaging the knife's blade edge by finger pressure alone.

A still further objective is to provide such an invention capable of sharpening a knife blade during normal retraction of the blade.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention in at least one of its preferred embodiments, which is further defined in detail in the following description.

Figure 1:
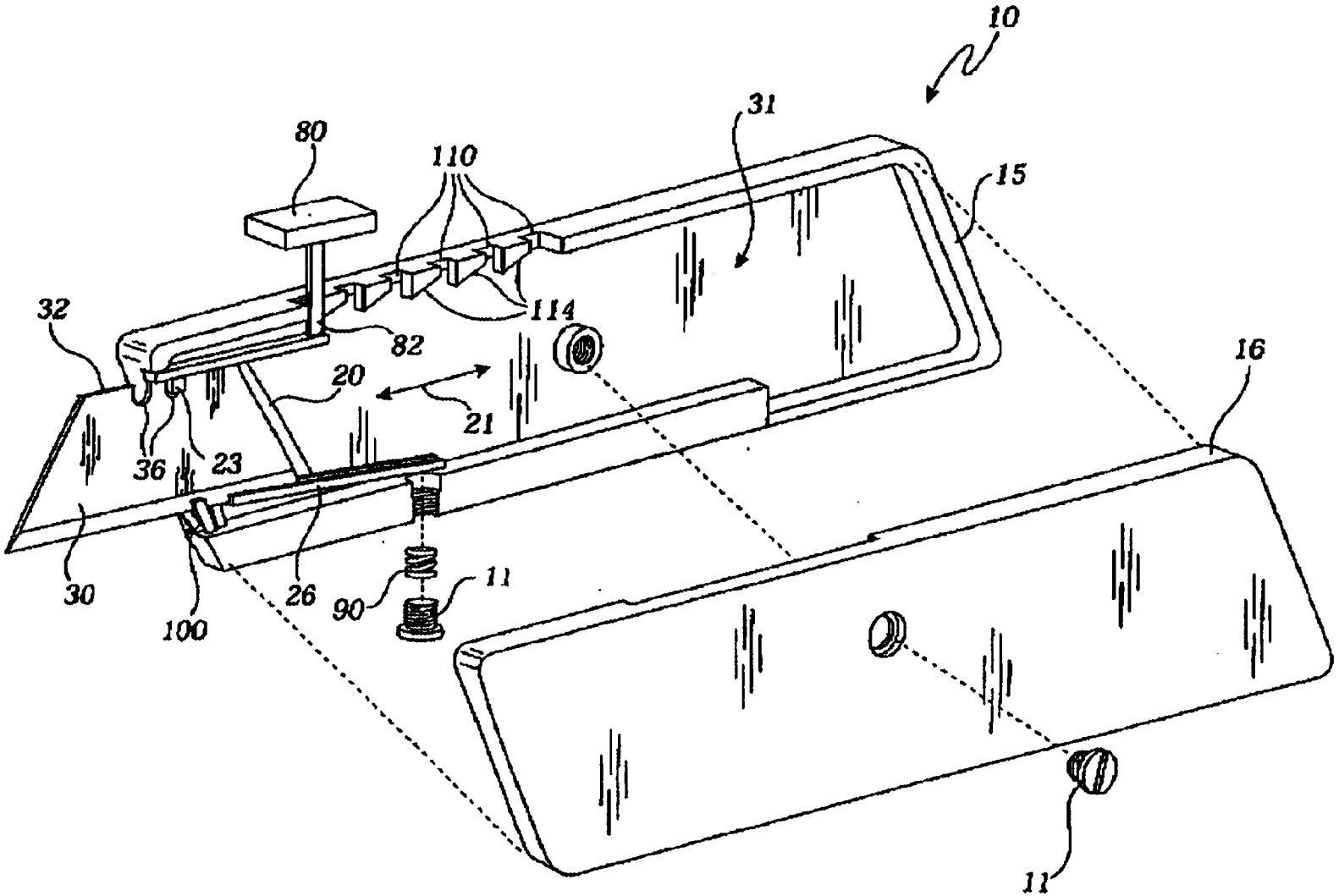
FIG. 1 is an exploded perspective view of the preferred embodiment of the invention showing a housing, blade carrier and blade of the invention.
Figure 5:
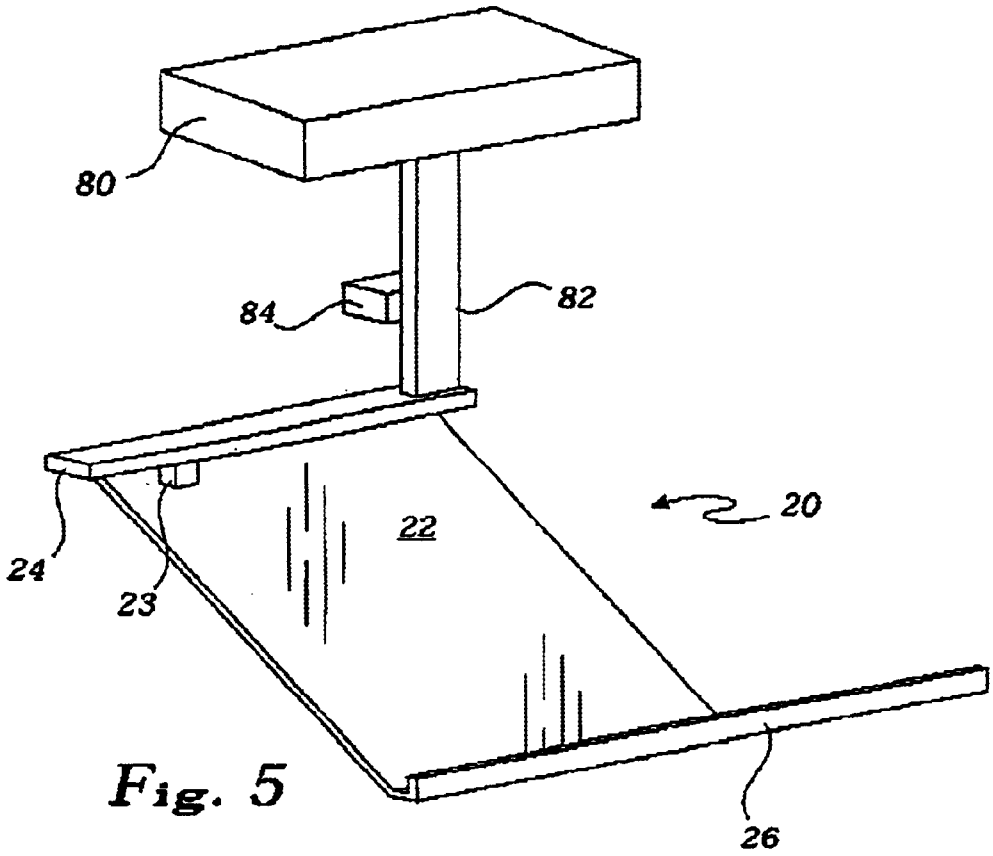
FIG. 5 is a perspective view of a blade carrier of the invention.

The present invention is a cutter apparatus comprising a blade housing 10; a blade carrier 20, as best understood from FIG. 5; and a blade 30 of any common type used for box cutting. The blade housing 10 is enabled for receiving the blade carrier 20 in sliding engagement because it has a hollow cavity 31 as shown in FIG. 1. This permits motion of the carrier 20 in a longitudinal direction within the housing 10. See arrow 21 in FIG. 1. This motion drives the carrier 20 between a retracted blade position 40 (FIG. 2) and an extended blade position 50 (FIG. 3). The blade carrier 20 provides a means 60 for holding of the blade 30 in a preferred attitude within the housing 10, a means 23 for securing of the blade 30 in the preferred attitude, and a means 80 for pushing of the blade carrier between the retracted blade position 40 and the extended blade position 50. The blade housing 10 provides a means 90 for biasing of the blade carrier 20 in an upward direction within the housing 10, a means 100 for sharpening of the blade 30, and a means 110 for engaging (slots) of the blade carrier 20 at plural positions between, and including, the retracted blade position 40 and the extended blade position 50. The pushing means 80 is cooperable with the biasing means 90 for disengaging the blade carrier 20 from the engaging means 110 for extension and retraction of the blade carrier 20 without contact between the blade 30 and the sharpening means 100 and alternately, for disengaging the blade carrier 20 from the engaging means 110 for extension and retraction of the blade carrier 20 with contact between the blade 30 and the sharpening means 100. In other words, motion of the blade 30 may be executed while sharpening the blade or not.

Preferably, the blade housing 10 comprises two housing half-shells 15, 16 joined along a vertical seam as shown in FIG. 1 and fastened by screw 11.

Preferably, the holding means 60 of the blade carrier 20 comprises, integrally, a blade face abutting surface 22 (FIG. 6), an upper flange 24 contacting a top edge 32 of the blade 30, and a lower flange 26 contacting a cutting edge 34 of the blade 30.

Preferably, the securing means 23 of the blade carrier 20 comprises a finger extending perpendicularly from the face abutting surface 22 and engaging a notch 36 in the blade 30.

Figure 2:
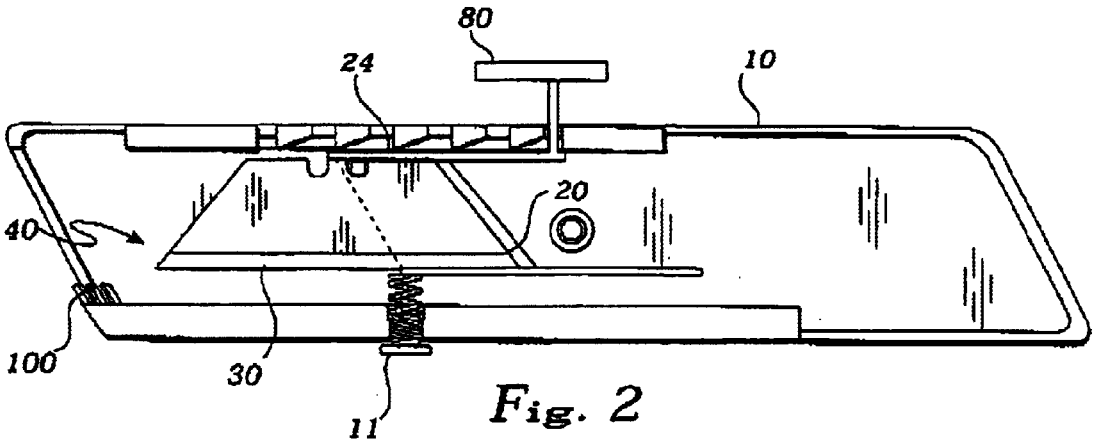
FIG. 2 is an elevational view thereof showing a side portion of the housing with the blade of the invention in a fully retracted position.
Figure 3:
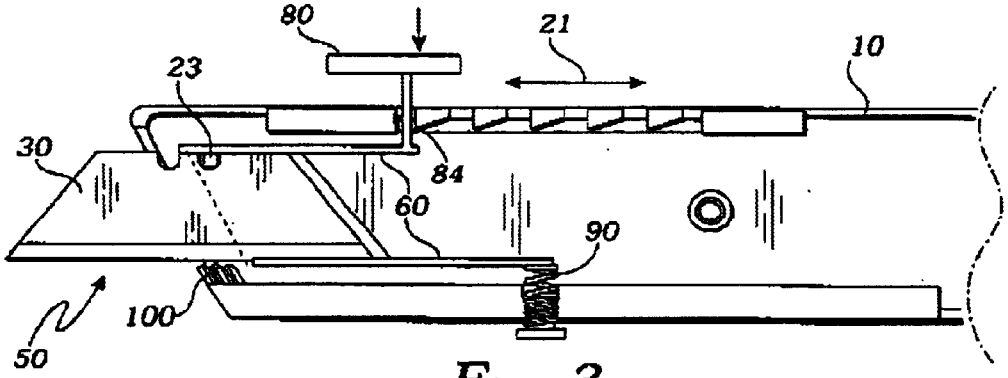
FIG. 3 is an elevational view thereof showing the side portion of the housing with the blade of the invention in a partially depressed position for freely moving the blade longitudinally within the housing.
Figure 4:
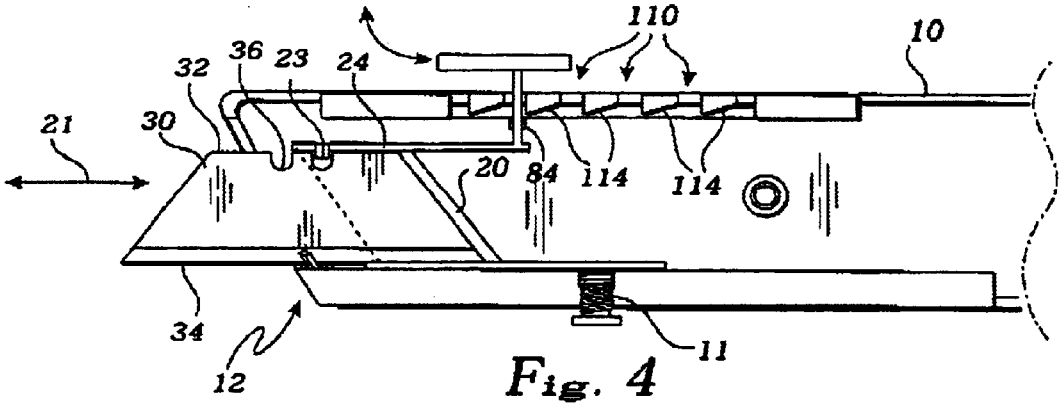
FIG. 4 is an elevational view thereof showing the side portion of the housing with the blade of the invention in a fully depressed position in contact with sharpening surfaces.

Preferably, the pushing means 80 of the blade carrier 20 provides a lever arm 82 extending upwardly from the upper flange 24, to a position above the blade housing 10 enabling finger manipulation thereof, i.e., the pushing means 80 is able to effect motion of the blade carrier 20 in directions shown by arrow 21 in FIG. 1, and also vertical motion of the blade carrier, illustrated by the relative positions of the blade carrier 20 shown in FIGS. 2–4 respectively. In FIG. 2 the carrier 20 is shown in its extreme upright position as urged by biasing means 90 as would be the case when the apparatus is inactive. In FIG. 3, the carrier 20 is shown as it would be positioned if pushed partially downwardly against the biasing means 90, but not fully depressed. In this case the carriage is free to move as shown by arrow 21, but the blade 30 is not engaged with sharpening means 100. Finally, in FIG. 4, the carrier 20 is positioned as if pushed fully downwardly against the biasing means 90 and the blade 30 is engaged with sharpening means 100. Here too, the blade 30 is free to move as shown by arrow 21.

Preferably, the biasing means 90 of the blade housing 10 is a spring engaged with the lower flange 26 of the blade carrier 20 enabling an upward bias of the blade carrier 20 within the blade housing 10. By pressing downwardly on pushing means 80, the spring is depressed and the carriage 20 is moved downwardly.

Figure 6:
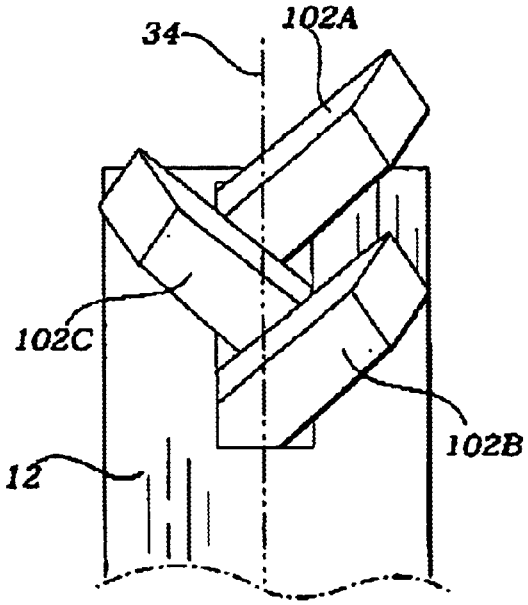
FIG. 6 is a plan view of three sharpening stones of the invention as mounted in the housing.

Preferably, the sharpening means 100 are abrasive stones with at least two abrasive surfaces in face-to-face orientation and downwardly convergent juxtaposition and more preferably, as shown in FIG. 6, comprises three abrasive surfaces 102A, 102B and 102C, with two of said three surfaces 102A and 102B aligned in face-to-face and downward convergent juxtaposition in relation to a third one 102B of the surfaces. Preferably, the three abrasive surfaces 102A–C are mounted at a blade extension end 12 of the blade housing 10 in a position adapted to slidingly receive the cutting edge 34 of the blade 30 during extension and retraction thereof when the carriage 10 is fully depressed as shown in FIG. 4. The primary benefit of the use of three abrasive surfaces arranged as shown in FIG. 6, is to enable sharpening of the cutting edge 34 right up to the tip of the blade 30.

Preferably, the engaging means comprises plural transverse slots 110 within the blade housing 10, the transverse slots 110 arranged in longitudinally sequenced order. Preferably, an interior surface 114 between each adjacent pair of the transverse slots 110 is angled downwardly in a direction toward the sharpening means 100. Preferably, the lever arm 82 provides a locking tab 84 that is positioned for engaging the transverse slots 110 for locking the carriage 20 and blade 30 at a selected degree of extension forward the blade housing 10 or for locking the blade 30 within the housing 10, wherein partial depression of the pushing means 80 disengages the locking tab 84 from any one of the slots 110 enabling movement of the blade carrier 20 longitudinally.

Preferably, partial depression of the pushing means 80 and forward motion of the blade carrier 20 produces sliding of locking tab 84 along the angled interior surfaces 114 between slots 110, while pressing forward on the pushing means 80 causes further compressing of the biasing means 90 increasing upwardly directed biasing force on the blade carrier 20 and the pushing means 80, such that the locking tab 84 tends to engage the next slot 110 when aligned with it.

Preferably, full depression of the pushing means 80 coupled with sliding motion of the blade carrier 20 enables full contact between the cutting edge 34 of blade 30 and the sharpening surfaces 102A–C. Sharpening action can be accomplished with the blade 30 moving in either direction as shown by arrow 21.

As can be seen from the above, the cutter apparatus provides a blade housing 10 with a blade carrier 20 having a blade 30 engaged within the blade carrier 20. The blade housing 10 is enabled for receiving the blade carrier 20 and blade 30 in sliding longitudinal motion within the blade housing 10 between the retracted blade position 40 and the extended blade position 50. The blade carrier 20 is further movable between an upwardly biased position, shown in FIG. 2, and a downwardly depressed position, shown in FIG. 4, within the blade housing 10. The biasing means 90 urges the blade carrier 20 toward the upwardly biased position for locking the blade 30 at any one of a plurality of slots 110 which are enabled for fixing the blade 30 at a selected degree of extension forward of the blade housing 10. The pushing means 80, with slight pressure applied in a downward direction, directs the blade carrier 20 for disengaging from the slots 110 enabling longitudinal motion within the housing 10. Further downward pressure on the pushing means 80 directs full depression of the blade carrier 20 thereby engaging the cutting edge of the blade 30 with the sharpening means 100 for honing the blade 30 as the blade carrier 20 moves longitudinally in either direction.

While the invention has been described with reference to at least one preferred embodiment, it is to be clearly understood by those skilled in the art that the invention is not limited thereto. Rather, the scope of the invention is to be interpreted only in conjunction with the appended claims and it is made clear, here, that the inventor(s) believe that the claimed subject matter is the invention.

What is claimed is:

1. A cutter apparatus comprising: a blade housing; a blade carrier; and a blade; the blade housing enabled for receiving the blade carrier in sliding engagement within the blade housing in a longitudinal direction, between a retracted blade position and an extended blade position; the blade carrier providing a means for holding the blade in a preferred attitude, a means for securing the blade in the preferred attitude, and a means for pushing the blade carrier between the retracted blade position and the extended blade position; the blade housing providing a means for biasing the blade carrier in an upward direction, a means for sharpening the blade, and a means for engaging the blade carrier at plural longitudinal positions between, and including, the retracted blade position and the extended blade position; the pushing means cooperable with the biasing means for, with a downward pressure on the pushing means, disengaging the blade carrier from the engaging means for extension and retraction of the blade without contact between the blade and the sharpening means and alternately, with further downward pressure on the pushing means, for disengaging the blade carrier from the engaging means for extension and retraction of the blade carrier and forcing contact between the blade and the sharpening means.

2. The apparatus of claim 1 wherein the blade housing comprises two housing half-shells abutting along a vertical seam.

3. The apparatus of claim 1 wherein the holding means of the blade carrier provides, integrally, a blade face abutting surface, an upper flange contacting a top edge of the blade, and a lower flange contacting a cutting edge of the blade.

4. The apparatus of claim 3 wherein the securing means of the blade carrier comprises a finger extending perpendicularly from the face abutting surface engaging a notch in the blade.

5. The apparatus of claim 3 wherein the pushing means of the blade carrier provides a lever arm extending upwardly from the upper flange, to a position above the blade housing enabling finger manipulation thereof.

6. The apparatus of claim 1 wherein the biasing means of the blade housing is a spring engaged with the lower flange of the blade carrier enabling upward positioning of the blade carrier within the blade housing.

7. The apparatus of claim 1 wherein the sharpening means is at least two abrasive surfaces in face-to-face and downwardly convergent juxtaposition.

8. The apparatus of claim 7 wherein the sharpening means comprises three abrasive surfaces with two of said three surfaces aligned in face-to-face and downward convergent juxtaposition relative to a third one of the surfaces.

9. The apparatus of claim 8 wherein the three abrasive surfaces are mounted at a blade extension end of the blade housing in position to slidingly receive the cutting edge of the blade during extension and retraction thereof.

10. The apparatus of claim 1 wherein the engaging means comprises plural transverse slots within the blade housing, the transverse slots arranged longitudinally.

11. The apparatus of claim 10 wherein an interior surface between each adjacent pair of the slots is angled downwardly away from the sharpening means.

12. The apparatus of claim 11 wherein a locking tab of the pushing means is positioned for engaging the transverse slots for locking the blade at a selected degree of extension forward the blade housing, wherein depression of the pushing means disengages the locking tab from any one of the slots enabling blade carrier movement.

13. The apparatus of claim 12 wherein partial depression of the pushing means disengages the locking tab from any one of the slots, whereupon rearward motion of the pushing means slides the locking tab along the angled interior surface, further compressing the biasing means and increasing upwardly directed biasing force on the blade carrier and the pushing means.

14. The apparatus of claim 13 wherein full depression of the pushing means coupled with sliding motion of the blade enables full contact between the blade and the sharpening means thereby sharpening the cutting edge of the blade.

15. A cutter apparatus comprising: a blade housing; a blade carrier; and a blade engaged within the blade carrier; the blade housing enabled for receiving the blade carrier and blade in sliding engagement within the blade housing in a longitudinal direction, between a retracted blade position and an extended blade position; the blade carrier further movable between an upwardly biased position and a downwardly depressed position within the blade housing; a biasing means urging the blade carrier to the upwardly biased position for locking the blade carrier with one of a plurality of slots enabled for fixing the blade at a selected degree of extension forward of the blade housing; the blade carrier further providing a means for directing partial depression of the blade carrier thereby disengaging the blade carrier from the slots and enabling longitudinal motion thereof, and further enabled for directing full depression of the blade carrier thereby engaging a cutting edge of the blade with a sharpening means for honing the blade as the blade carrier moves longitudinally within the housing.

* * * * *